US007237735B2

(12) United States Patent
Tirschler

(10) Patent No.: US 7,237,735 B2
(45) Date of Patent: Jul. 3, 2007

(54) ANGLE-BASED METHOD AND DEVICE FOR PROTECTING A ROTATING COMPONENT

(76) Inventor: Ehrenfried Albert Tirschler, 2034, ch. Bord du Lac, Ile-Bizard, QBC (CA) H9C 1A4

( * ) Notice: Subject to any disclaimer, the term of this patent is extended or adjusted under 35 U.S.C. 154(b) by 0 days.

(21) Appl. No.: 11/332,336

(22) Filed: Jan. 17, 2006

(65) Prior Publication Data

US 2006/0113416 A1 Jun. 1, 2006

Related U.S. Application Data

(62) Division of application No. 10/244,479, filed on Sep. 17, 2002, now Pat. No. 7,017,841.

(51) Int. Cl.
*B02C 25/00* (2006.01)

(52) U.S. Cl. ..... 241/36

(58) Field of Classification Search ..... 241/30, 241/35, 36, 299

See application file for complete search history.

(56) References Cited

U.S. PATENT DOCUMENTS 4,123,009 A * 10/1978 Kilpinen ..... 241/30
4,635,858 A * 1/1987 Welch et al. ..... 241/16

FOREIGN PATENT DOCUMENTS

JP 54-99262 * 8/1978

* cited by examiner

*Primary Examiner*—Mark Rosenbaum
(74) *Attorney, Agent, or Firm*—Equinox; Franz Bonsang, patent agent

(57) ABSTRACT

A method and device to protect a grinding mill, at startup from a gravity-balanced condition thereof, used for grinding material therein by rotating the drum so that the material adheres to the drum inner surface and rises therewith over a cascading angle from a startup position at the gravity-balanced condition prior to detach by gravity from the inner surface and tumble into a cascading flow. The method is used for protecting the grinding mill from damages potentially resulting from the material agglomerating into a generally solidified lumped volume that could adhere to the inner surface and rotate therewith more than the cascading angle to a fall angle wherein the lumped volume may detach from the inner surface and impact an impact position within the drum.

11 Claims, 5 Drawing Sheets

ANGLE-BASED METHOD AND DEVICE FOR PROTECTING A ROTATING COMPONENT

CROSS REFERENCE TO RELATED APPLICATIONS

The present invention is a divisional application of application Ser. No. 10/244,479 filed on Sep. 17, 2002, now U.S. Pat. No. 7,017,841.

FIELD OF THE INVENTION

The present invention relates to the general field of rotating machines and is particularly concerned with an angle-based protection device and method for protecting a rotating component part of a machine.

BACKGROUND OF THE INVENTION

The prior art is replete with various types of machines having rotating components for industrial, domestic, recreational and other purposes. Because of particular physical phenomenons associated with rotating movements, rotating components part of various types of machines are subjected to particular operational parameters that may be potentially damaging especially when the rotating components reach critical angular values. The potential for subjecting rotating components to damaging conditions is sometimes compounded when the rotating components are used for imparting a rotational movement to material contained therein, such as for mixing, grinding or other purposes.

So-called grinding mills constitute a typical example of a machine having a rotating component, namely a rotating drum that may be subjected to potentially damaging conditions upon operational parameters of the machine meeting pre-determined critical parameter conditions while the rotating drum reaches a critical angular value. Such grinding mills are used extensively for reducing lumps or large pieces of various kinds of material to smaller sizes.

Conventional grinding mills commonly include a hollow cylindrical or frusto-conical shell or drum mounted for rotation about its longitudinal axis. The drum is typically rotatably arranged about two trunnions by two head portions positioned at opposite longitudinal ends of the drum.

Typically, each conical head portion includes a plurality of segments bolted together to form a composite structure. Each head portion is also typically provided an inner annular flange and an outer annular flange for securing the head portions respectively to a trunnion and to the drum.

Also, conventional grinding mills are typically provided with a gear wheel forming part of the gear mechanism that drives the grinding mill. The gear wheel commonly includes a plurality of segmental rim portions that are bolted together to form an annular rim. Gear teeth are cut into the rim and shaped for cooperation with one or more pinions. The annular rim is typically displaced radially outward of the drum by a rib. The rib is usually provided with a plurality of apertures through which bolts may pass to fasten the rib to the outer annular flange of the head portion and the flange of the drum.

The gear wheel typically forms part of a large speed-reducing gear system intended to transmit the power from a prime mover to the grinding mill. The prime mover, in turn, typically includes an electrical prime mover such as synchronous electrical motors or the like having enhanced starting torque characteristics. In order to compensate for enhanced starting torque, the gear wheel typically has a relatively large diameter.

Different diameters and lengths of shells or drums have been used heretofore, and they normally vary in proportion to the capacity of the mill. During rotation of the drum about its longitudinal axis, the material to be ground is carried up the side of the drum to subsequently fall to the bottom of the drum. The grinding occurs principally by attrition and impact within the grinding mill charge.

In the case of ore, the normal function of the grinding mill is to reduce the size of the ore to particles within a fine sieve range for flotation. Grinding mills used for grinding ores or the like optionally use grinding mediums such as pebbles, steel balls, ceramic balls, or the like to assist in the comminuting process as the mill is rotated.

In other circumstances, the ore may be self-grinding. The axial ends of the drum may be open, and the material to be comminuted may be continuously fed into the mill at one end with the comminuted product continuously emerging from the other end.

In view of the abrasive character of the material being ground, the wear on the inside of the grinding mill has heretofore been a serious problem. Hence, in order to protect the drum from the grinding action and to thereby lengthen the life of the grinding mill, the drum is typically provided with a metal or rubber lining. For example, grinding mills have been lined with cast or wrought abrasion-resistant ferrous alloy liners and, in some cases, rubber or ceramic liners. Typically, these liners are segmented due to the weight and size considerations.

Liner assemblies hence typically include a plurality of separate lining components that are usually retained tightly against the interior or the mill shell or drum by mechanical fastening components such as bolts. Some ores, such as taconite, are relatively highly abrasive. In order to maintain continuous operation of the grinding mill, it is necessary to provide a liner for the drum that is highly abrasion-resistant. The liner also should be tough enough to withstand the continuous impact of ore fragments.

Liners inevitably become worn and, hence, no longer effective. In such situations, the liners are typically replaced at periodic intervals. Other types of maintenance and repair also periodically require the grinding mill to be run at speeds considerably slower than the normal running speed or even to stop the rotation movement of the drum altogether.

As a result of mill shut-down over a period of time, the charge within the mill may "freeze" into a generally solidified, hardened or rigid lump. Upon the mill being rotated after a mill shut-down there exists the possibility that the solidified lump will be carried up the side of the drum by the rotation of the latter. In such instances, instead of tumbling in a cascading flow upon reaching the position wherein non-solidified charge would cascade, the mass may eventually detach itself from the inner wall of the drum and fall on an impacting location within the drum.

This may prove to be detrimental to various components of the mill including the lining, heads and bearings thereof. Also, since gear wheels are typically constructed with great accuracy, they may also be subjected to deformation by the impact. As can be appreciated, when the lining is affected or when a tooth in a gear wheel is damaged, the liner and the wheel must be replaced. The cost of the occurrence of such events is very burdensome. Not only is the cost of material and repair involved extensive but the high capitalization costs of plants using large autogenous mills may be mobilized by extended non-productive down-time.

A solidified mass falling from the mill inner wall upon rotation of the latter constitutes a typical example of a rotating component that may be subjected to potentially damaging conditions upon the rotating component reaching a critical angular value. Another example of angle-dependent potentially damaging conditions may result from the potential mismatch between actual load and designed torques.

Indeed, as the mill is rotated to the cascade position wherein the charge starts to tumble, the torque required increases quite considerably as the charge is moved away from the gravity-balanced position on a large radius. Once the charge begins to tumble, the required load torque drops. If the developed motor torque matches the load torque plus the friction torque, then the rotation will be smooth and continuous.

It would be desirable to provide an angle-based protection device for protecting rotating component and corresponding supporting component part of machines. More particularly, in some situations the rotating component defines a critical angular value about which an operational parameter of the machine may be used for predicting the occurrence of a potentially damaging condition for the machine. Also, sometimes the potentially damaging condition for the machine is concurrently more susceptible to happen upon the operational parameter meeting predetermined critical parameter conditions while the rotating component reaches a critical angular displacement value. In such situations, it would be desirable to provide an angle-based protection device for reducing the risk of such potentially damaging conditions occurring.

As mentioned previously, it is some times desirable to run the grinding mill at speeds considerably slower than the normal running speed. Typical examples include for the purpose of assuring proper gear, bearing and shaft alignment when a mill is first being installed, also for inspecting and potentially replacing the mill liner when the mill is empty or to start the mill after it has been stopped with a full charge. This slow running is often referred to as "spotting", "inching", "barring" or "turning gear".

Heretofore, inching has been accomplished in several ways. One of the simplest mechanical device used for inching includes a cable sling arrangement attached to an overhead crane. The cable sling arrangement allows for selective mill rotation. However, such a prior art technique is not precise. Also, it requires continuous use of a crane. Furthermore, it is dangerous to personnel who may be installing or re-lining the mill as slings have a known tendency to break.

Another way to provide for inching uses a low frequency power source to provide power to the stator windings of the typically used three-phase synchronous drive motors. The low frequency power source may be a direct current (DC) supply connected to an inching supplied bus for the motors through a series of electromechanical or static switches to produce stepped low frequency three-phase voltages. These switches are typically referred to as sequencing or commutating switches. The switches, however, are relatively costly.

Inching has heretofore also been accomplished through the use of clutches, the clutches may be partially engaged to cause rotation of the mill at lower speeds. This partial clutch closure for long periods however generates considerable heat in the clutches and requires that the wet clutches be installed and provision made to dissipate the heat generated. Also, typically, an installation using wet clutches is more expensive than one using dry clutches.

Yet, another way to provide for inching is to use a removable hydraulic motor that is placed to engage main mill pinion gear. The present invention is particularly well suited for use with such inching devices. However, it can be appreciated by those skilled in the art that the present invention has broader applications and be used in conjunction with other types of machinery for obtaining an angle-based protection device.

SUMMARY OF THE INVENTION

Advantages of the present invention include that the proposed angle-based protection device and method is intended to prevent angle-based potentially damaging conditions from damaging rotating components. For example, the proposed angle-based protection device and method can be used for preventing a solidified mass within a conventional grinding mill from impacting the mill and damaging the latter upon rotation of the mill drum. The proposed device may also be used for preventing damages caused by actual load torque and designed torque mismatches or any other angle-based potentially damaging conditions.

The proposed device may be readily installed on conventional machines such as conventional grinding mills, inching devices or the like, through a set of quick and ergonomic steps. The proposed device and method may also be easily retrofitted to existing machines without requiring undue work and with reduced risks of damaging the machines.

The proposed method and device is intended to protect the machine with reduced interference to its operational parameters so as to provide a device having reduced risks of lowering the efficiency of the machine on which it is mounted. Also, the proposed method may be accomplished through the use of various types of devices including devices readily commercially available.

Furthermore, the proposed device is designed so as to be manufacturable using conventional forms of manufacturing so as to provide an angle-based protection device that will be economically feasible, long-lasting and relatively trouble-free in operation.

According to an aspect of the present invention, there is provided a device for protecting a grinding mill, at startup from a gravity-balanced condition thereof, including a rotating mill drum used for grinding material from damages caused by a potentially damaging lumped volume of said material falling from a fall position within said rotating drum and impacting an impact position within said rotating drum upon rotation thereof at startup from the gravity-balanced condition, said rotating drum being coupled to a torque provider able to generate a driving torque for rotation of said rotating drum, a presence of said potentially damaging lumped volume of said material being predictable upon an operational parameter of said grinding mill being in relation with said rotating drum meeting predetermined critical parameter conditions corresponding thereto, said device comprises: a parameter sensor operatively coupled to said grinding mill for providing an evaluation of said operational parameter upon said rotating drum moving at startup from the gravity-balanced condition, said parameter sensor assessing the presence of said potentially damaging lumped volume of said material from the evaluation of said operational parameter meeting said predetermined critical parameter conditions; an effectuator operatively coupled to the torque provider and to said parameter sensor for receiving an assessment of the presence of said potentially damaging lumped volume of said material thereform, said effectuator initiating an action for reducing the risks of damaging said grinding mill upon reception of the assessment of the presence of said potentially damaging lumped volume of said material.

In one embodiment, the rotating drum has a drum peripheral wall defining a peripheral wall reference location and an inner surface thereof; and said rotating drum defines a critical angular displacement value within which said material within said rotating drum is expected to separate from said inner surface of said rotating drum and tumble in a cascading flow upon rotation of said rotating drum and about which said operational parameter of said grinding mill may be used for predicting the occurrence of a potentially damaging condition for said grinding mill in relation with said rotating drum reaching said predetermined critical parameter conditions; said parameter sensor including an angle evaluator for providing an evaluation of an angular displacement relationship between said peripheral wall reference location and said critical angular displacement value of said rotating drum from a startup position corresponding to the gravity-balanced condition.

In one embodiment, the parameter sensor further includes: a torque evaluator for evaluating said driving torque relative to said angular displacement relationship during rotation of said rotating drum from said startup position.

Typically, the angle evaluator includes a rotation encoder operatively coupled to said grinding mill for converting an operational parameter of said grinding mill into an estimate of the angular displacement of said rotating drum from the startup position at said gravity-balanced condition.

In one embodiment, the rotation encoder includes: a reference component mounted on a driving shaft of said torque provider for rotating therewith; an inductive-type sensor mounted adjacent said reference component for monitoring a displacement of said reference component and inferring the angular displacement of said rotating drum from the displacement of said reference component.

In one embodiment, the torque evaluator includes a torque transducer operatively coupled to an inching device of said torque provider for assessing a torque provided by said inching device.

Typically, the inching device includes a hydraulic motor, said torque transducer is a pressure transducer operatively coupled to a hydraulic circuitry of said hydraulic motor for assessing a hydraulic pressure in the hydraulic circuitry and provide to determine the torque provided by said hydraulic motor.

Conveniently, the rotation encoder is mounted on said inching device.

Alternatively, the torque provider is an electrical driving motor coupled to said grinding mill, or an inching device including a hydraulic driving motor.

Other objects and advantages of the present invention will become apparent from a careful reading of the detailed description provided herein, within appropriate reference to the accompanying drawings.

BRIEF DESCRIPTION OF THE DRAWINGS

An embodiment of the present invention will now be disclosed, by way of example, in reference to the following drawings in which.

DETAILED DESCRIPTION OF THE PREFERRED EMBODIMENTS

With reference to the annexed drawings a preferred embodiments of the present invention will be herein described for indicative purpose and by no means as of limitation.

Figure 1:
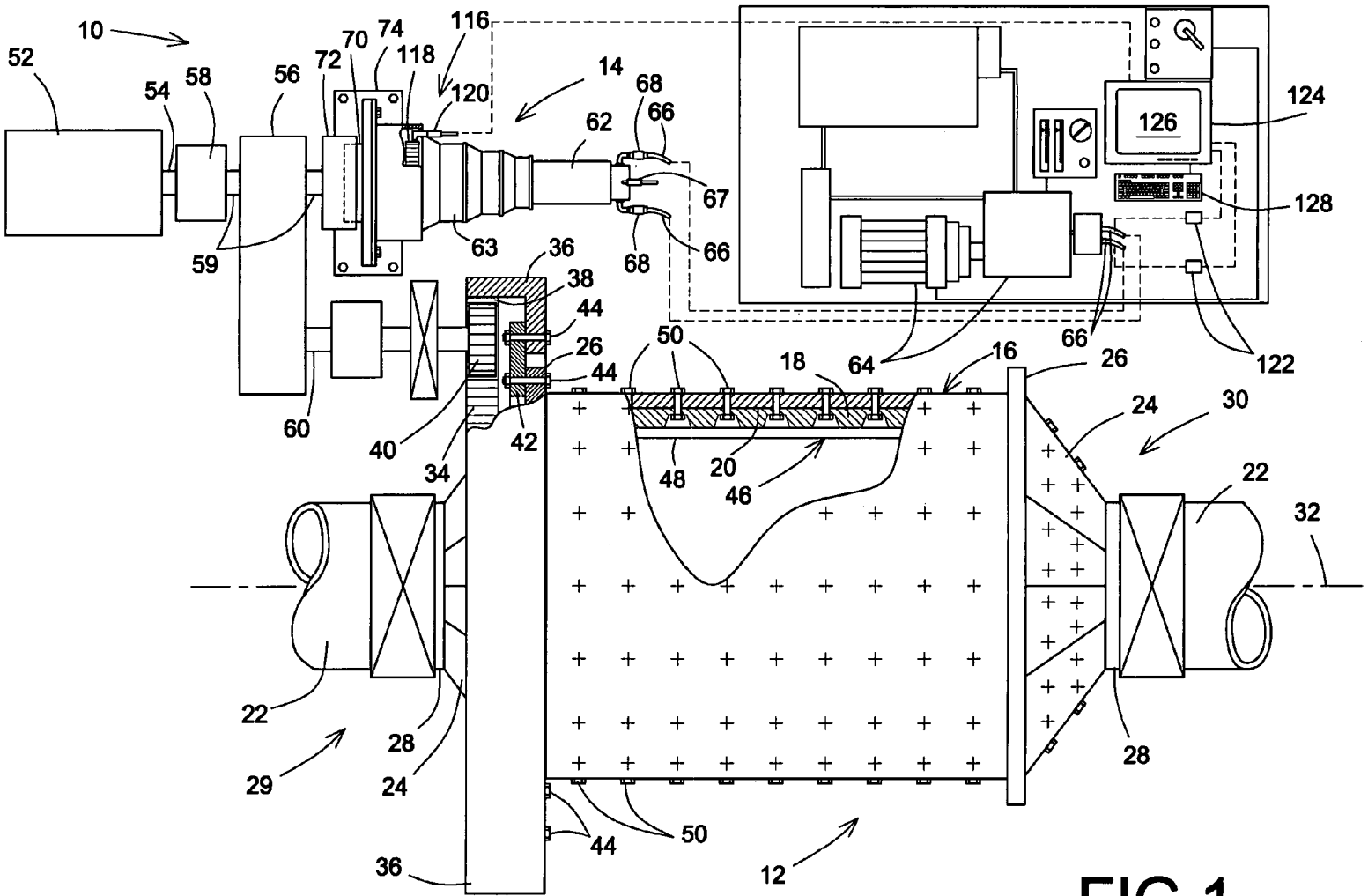
FIG. 1, in a partially broken schematic top plan view, illustrates the protection device in accordance with an embodiment of the present invention, the protection device being used with a conventional hydraulic inching device coupled to a conventional grinding mill.

Referring to FIG. 1, there is shown a protection device generally indicated by reference numeral 10 in accordance with an embodiment of the present invention. The protection device 10 is shown being used with a conventional grinding mill 12 and a conventional hydraulic inching device 14. It should be understood that this type of installation merely represents one type of exemplary installation through which the concepts of the subject invention may be intended to be used and will allow those skilled in the art to more readily appreciate the general gist of the application for the proposed protection device. The protection device 10 may be used in other environments in conjunction with other types of machinery without departing from the overall intent or scope of the present invention.

The grinding mill 12 includes a hollow mill drum 16 having a drum peripheral wall 18 defining the drum wall inner surface 20. The mill drum 16 is rotatably arranged about two trunnions 22 by a pair of conical heads 24 positioned at opposite ends of the mill drum 16. Each head 24 is provided with an inner annular flange 26 and an outer annular flange 28 for securing the head respectively to mill drum 16 and to an adjacent trunnion 22.

Preferably, the mill drum 16 defines a feed end area or face 29 and an opposed discharge end area or face 30. The mill drum 16 is preferably generally horizontally journalled to the trunnions 22 so as to be rotatably driven about its longitudinal axis 32 and typically extends in a generally slightly tilted or sloped orientation from horizontal.

The grinding mill 12 is typically further provided with a gear ring or wheel 34 forming part of the gear mechanism for driving the grinding mill 12. The gear wheel 34 commonly includes a plurality of segmental rim portions that are bolted together to form an annular rim 36. Cut into the rim 36 are teeth 38 cooperating with one or more pinions 40. Typically, the annular rim 36 is placed radially outward of the drum of the mill drum 16 by a rib 42.

The rib 42 is usually provided with a plurality of rib apertures extending therethrough for allowing bolts 44 to fasten the rib 42 to the inner annular flange 26 of the head 24 and the flange of the mill drum 16.

A lining 46 is typically provided over the drum inner surface 20 to protect the latter from the grinding action and thereby lengthen the life of the grinding mill 12. The lining 46 may take any suitable form such as an assembly of modular longitudinal lining sections or an assembly of elongated slabs 48 preferably having wedge-shaped ribs 49 or the like thereon. The slabs 48 are forcibly held in place with radially extending fasteners 50. The lining 46 may be made out of any suitable material such as a suitable abrasive and impact resistant metal alloy or even elastomeric resin.

The grinding mill 12 is mechanically coupled to a prime mover able to provide a driving torque for rotating the mill drum 16. The prime mover typically includes an electrical-type of mover having enhanced starting torque characteristics. The prime mover typically includes an electric drive motor 52 enclosed in a drive motor housing.

The driving motor 52 includes a motor driving shaft 54 typically operatively communicating with a gear reducer structure 56 enclosed within a reducer housing via a motor clutch 58 operatively coupled to a reducer input shaft 59. A reducer output shaft 60 extends outwardly from the reducer 56. The reducer output shaft 60, or conventional pinion shaft, operatively communicates with the drive pinion gear 40. The drive pinion gear 40, in turn, is typically journalled in driving communication with bull or girth teeth 38 of the gear ring 34. Although the gear reducer 56 is preferred, the driving motor shaft 54 could alternatively be directly coupled to the pinion shaft 60.

Typically, the prime mover may include a pair of motors generating several thousands of horsepower for applying a relatively large torque at relatively slow speeds. The gear ring 34 typically has a relatively large diameter in order to compensate for enhanced starting torque. Also, the reducer 56 provides an output torque to the reducer output shaft 60 at a greater value and lower speeds than that of the driving shaft 54. The torque requirements will, of course, vary substantially between various mill installations and designs.

In use, typically, the grinding mill 12 is charged with the ore, rock or other material to be ground through an opening within the feed end area 29, preferably at the center thereof. As the ore, rock or other material is ground to the appropriate or desired size, it is discharged from the mill drum 16 through a similar discharge opening at the discharge end area 30. Typically, the ground material passes through a chute-like area (not shown) for transport to subsequent processing stations. Typically, the mill drum 16 is rotated about its longitudinal axis 32 so that the material being ground is continuously tumbled within the mill drum 16 and thereby pulverizes or breaks itself to the necessary size. Optionally, water or other solids and/or liquids, such as conventional manganese balls or the like, may be added to the material.

The grinding mill 12 is optionally releasably operatively coupled to the inching device 14 for allowing the grinding mill 12 to be run at speeds considerably slower than the normal running speed. The slow running of the grinding mill 12 often referred to as "spotting" or "inching" may be accomplished in several ways. Clutches may be used for coupling the prime mover through the grinding mill 12. These clutches may be partially engaged to cause rotation of the grinding mill 12 at lower speeds. Alternatively, low frequency power sources may be used to provide power to the stator windings of three-phase synchronous drive motors. The lower frequency power source may be a direct current (DC) supply connected to an inching supplied bus for the motors through a series of electro-mechanical or static switches to produce stepped low frequency three-phase voltages.

A third method for providing inching uses a removable hydraulic motor positioned so as to engage the reducer input shaft 59 or be mechanically coupled thereto. This third method of providing inching is illustrated in FIG. 1. The inching device 14 includes a hydraulic motor 62 combined with an inching brake assembly (not shown) which is typically a holding-type brake. Typically, the hydraulic motor 62 is a high-efficiency hydraulic motor coupled to a multi-stage planetary-type gear reducer 63. Typically, the inching brake assembly includes spring applied hydraulic released brakes. However, the hydraulic motor 62 may be of any suitable type without departing from the scope of the present invention.

The hydraulic motor 62 and its associated inching brake assembly are hydraulically coupled to an appropriate hydraulic pump and motor 64 through conventional hydraulic fluid lines 66. Optionally, mix-proof quick-disconnect couplings 68 may be used for coupling the hydraulic fluid lines 66 to the casing of the hydraulic motor 62. Typically, the brake assembly is mechanically biased to a braking condition and hydraulically actuated to a non-braking condition. The requisite hydraulic fluid lines 67 for the brake assembly are schematically shown in FIG. 1.

The hydraulic motor 62 includes a hydraulic motor output shaft 70. The hydraulic motor output shaft 70 is mechanically coupled to the reducer input shaft 59 through suitable coupling means such as a mounting hub 72 provided with hub teeth (not shown) for mechanical and directional engagement with shaft teeth (not shown) formed on the outer surface of the reducer input shaft 59.

Typically, the hydraulic motor 62 and corresponding brake assembly is mounted on a motor mounting bracket 74.

Again, it should be understood that any suitable type of inching device may be used without departing from the scope of the present invention.

Figure 3:
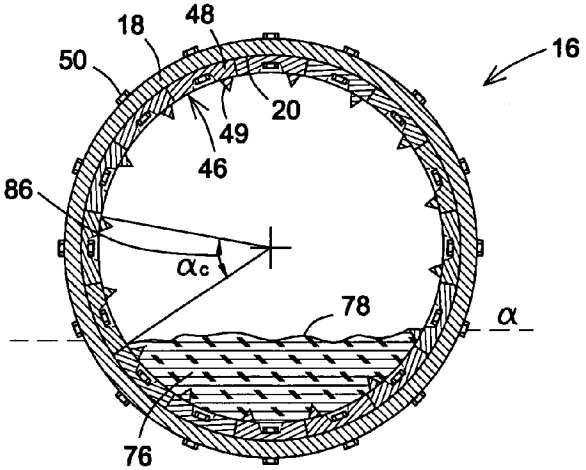
FIG. 3, in a transverse cross-sectional view of the drum shown in FIG. 2, illustrates, in a diagrammatic manner, an exemplary disposition of the grinding material and media when the latter is idle in gravity-balanced condition.

Referring now more specifically to FIG. 3, when the mill drum 16 is idle, the charge including the material to be ground and optionally solids/liquids as well as a grinding charge form a mass 76 at the bottom of the mill drum 16 having a somewhat irregular although generally horizontal top surface 78. The height of the top surface 78 and, hence, the amount of loading respective to the cross-sectional area of the mill drum 16 will depend upon various operational parameters. Hence, the particular loading shown in FIGS. 2 to 6 is only shown by way of example and other loading configurations and volumes could be used without departing from the scope of the present invention.

When a loaded grinding mill 12 is being inched, the rotation begins on the "rest", "idle" or "gravity-balanced" startup position shown in FIG. 3. As the mill is rotated according to arrow 80 in FIG. 2, a leading portion of the load 82 in contact with the lining 46 is carried upwardly according to arrows 84 up to a so-called cascading angular displacement 86. Since the grinding medium and subject material form a generally coherent mass, most of the load 82 will be moved by the rotation of the milling drum 16. Optionally, wedge-shaped ribs 49 or other suitable topographically enhancing means facilitate the carrying of the grinding medium and subject material with the drum during rotation thereof so as to enable the tumbling/cascading of the grinding medium and subject material, thereby creating the grinding action.

The material to be ground is carried up the side of the mill drum 16 to subsequently fall to the bottom of the drum 16 when the cascading displacement 86 is reached. The grinding occurs principally by attrition and impact within the grinding mill charge 82.

At the cascading angular displacement 86, the resultant forces acting on the charge 82 including friction, coherent and centrifugal forces tending to carry the load 82 up the side of the milling drum 16 and the gravitational and flowing forces tending to force the load 82 towards the bottom of the milling drum 16 cause the inner portion 88 of load 82 to tumble downwardly. Since the load 82 is typically relatively fluent, the outer portion 88 of load 82 will typically tumble in a cascading flow assuming somewhat the direction and configuration shown in FIG. 2. The material being generally fluent, tumbling of the top surface 78 will cause elements within the load 82 to fall upon other elements so as to enhance the crushing operation of the mill and produce a somewhat turbulent movement of the mass.

When a grinding mill 12 is being inched without a load or charge, for example to inspect the mill liners, the torque required is relatively constant and of a lesser value than required for normal running. However, when the grinding mill 12 is being inched, the required torque varies depending on the angular position of the leading edge of the load 82, as well as on the quantity of charge 82 therein.

Figure 7:
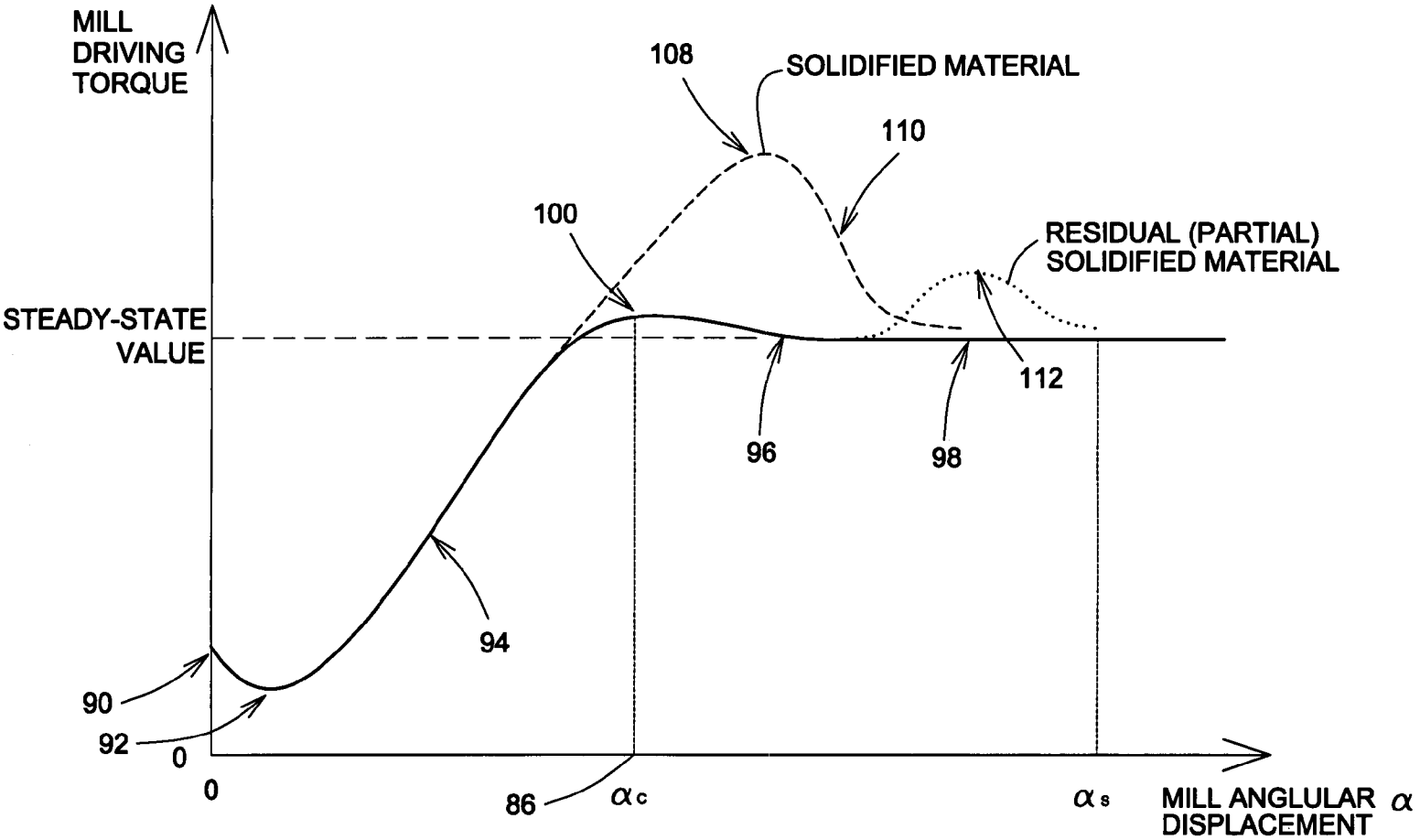
FIG. 7, in a graph, illustrates the typical relationship between the required driving torque and the drum rotation angle upon initiation of an inching process starting when the load is within the drum in an idle condition and ending when the load tumbles in a cascading flow.

Referring now more specifically to FIG. 7, there is shown that when a loaded mill is being inched with the rotation beginning from the idle position, the initial torque 90 required to begin rotation is relatively small. The initial torque 90 is typically required only to overcome friction and start the rotation of the milling drum 16. The torque requirements then typically decrease slightly as indicated at 92 when static friction is partially overcome. The required torque then begins to increase as drum mill 16 rotates and raises the load 82, with increasing mill angle $\alpha$, which had settled at the bottom when the mill was stopped in the gravity-balanced position. The torque continues to increase as indicated at 94 since the load is rotated farther away from the bottom position it had when the mill drum 16 was stopped, as illustrated in FIG. 3.

As the mill drum 16 is rotated or inched up by the cascading angular displacement 86 at which the charge 82 starts to tumble, the torque required increases quite considerably as the charge 82 is moved away from the gravity-balanced position on a large radius. Although shown in FIG. 2 as being typically about forty-five (45) degrees from the gravity-balanced position (shown in FIG. 3 with $\alpha$=0 degree), the cascading angular displacement 86 forming the cascading angle $\alpha_C$ could vary to be other angular displacements depending on the type and the quantity of material being ground without departing from the scope of the present invention.

Figure 2:
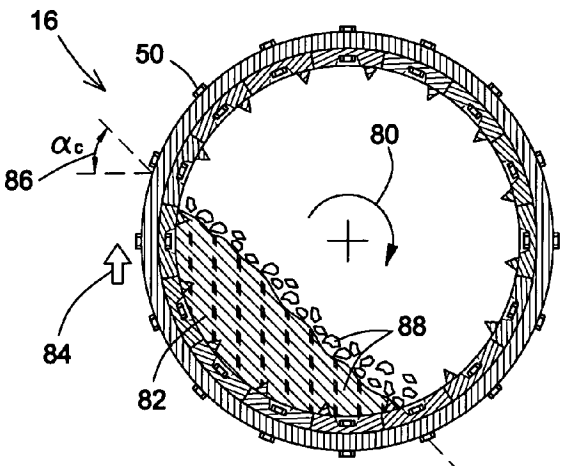
FIG. 2, in a transverse cross-sectional view of the drum part of the grinding mill shown in FIG. 1, illustrates, in a diagrammatic manner, an exemplary cascading and tumbling disposition of grinding media and material being ground thereby during the rotation of the mill in the direction of the arrow shown adjacent the Figure.

When the load 82 within the mill drum 16 cascades, as shown in FIG. 2, the torque requirement slightly decreases such as shown at 96 until a generally steady state or constant torque 98 is reached.

Obviously, the sloped portion ramped portion 94 must reach the steady or constant level 98 before the maximum load 100 is reached. In other words, before the load 82 is expected to cascade.

Depending on the gear ratios and the type of motors used, the ramped portion 94 may be associated with various time intervals after inching has started. In practice, as the load 82 in the milling drum 16 can be determined only with relatively poor accuracy before inching and, since the cascading angular displacement 86 varies, it is difficult to provide an accurate ramp reference prior to inching.

Figure 4:
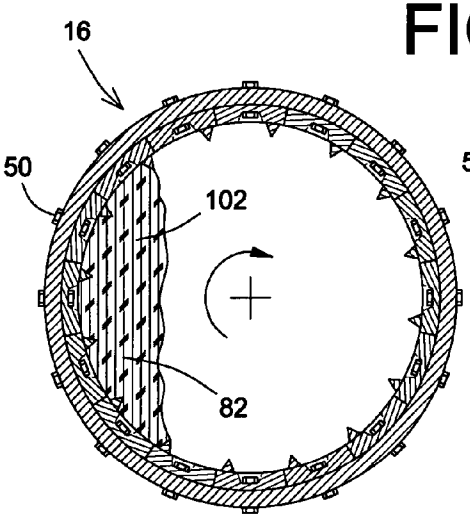
FIG. 4, in a transverse cross-sectional view of the drum shown in FIGS. 2, and 3, illustrates, in a diagrammatic manner, an exemplary disposition of the grinding material and media, fully solidified, is into an undesired position requiring more torque than the normal cascading operation.

FIG. 4 illustrates a situation wherein a fully solidified mass 102 has formed because of prolonged idling or other conditions. When such a condition occurs, the solidified mass 102 may be prevented from tumbling in a cascading flow at the cascading angular displacement 86 and remain attached to the lining 46.

Figure 5:
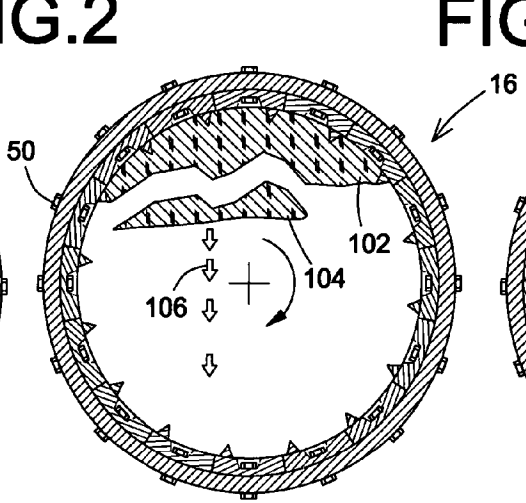
FIG. 5, in a transverse cross-sectional view of the drum shown in FIGS. 2, 3 and 4, illustrates, in a diagrammatic manner, an exemplary disposition of the solidified lump falling from the inner surface of the drum during the rotation of the mill in the direction of the arrow shown in the Figure.

In such situation, the mill 12 must be stopped from rotating and preferably held in that position to remedy to the potentially damaging situation otherwise a portion 104 or the totality of the solidified mass 102 may detach itself suddenly from the lining 46 at a somewhat remote location from the bottom of the grinding drum 16 and fall according to arrows 106 on the lining 46, as shown in FIG. 5. The fall of a relatively heavy mass may cause serious damages to various components of the grinding mill 12 including the lining 46, the driving gears and other important components.

Accordingly, the torque requirements continue to increase past the cascading angular displacement 86 as the solidified mass 102 is moved even further away from the gravity-balanced position on the large radius of the lining 46. Hence, instead of peaking at the cascading angular displacement 86 as designated by reference 100 in full lines, the required torque continues to increase as indicated at 108 due to the solidified mass 102, as shown in dashed lines in FIG. 7. Obviously, the initial sections of the ramped line are somewhat similar to the situation wherein the mass 102 eventually tumbles in a cascading flow at the cascading angular displacement 86.

Figure 6:
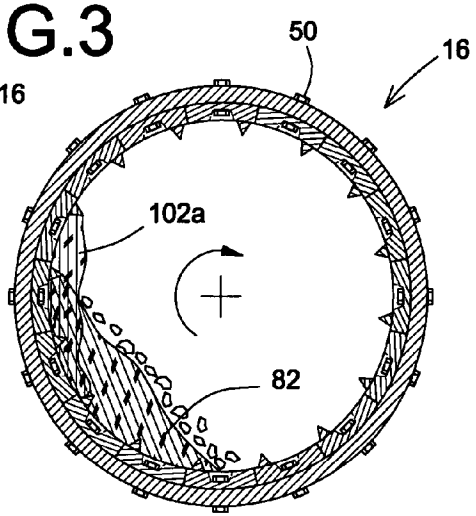
FIG. 6, in a transverse cross-sectional view of the drum shown in FIGS. 2, 3, 4 and 5 illustrates, in a diagrammatic manner, an exemplary disposition of the grinding material and media having a partially solidified lower portion reaching an undesired position also requiring more torque than the normal cascading operation.

Alternatively, as shown in FIG. 6, the solidified mass 102*a* can represent only a bottom or lower portion of the load 82. The solidified mass 102*a* will make the torque requirements to increase again after the constant torque 98 has been reached slightly following the start of the cascading on the non-solidified portion of the load 82, as represented by the second ramped dotted line 112 of FIG. 7. This situation can occur either when the solidified mass 102*a* is a portion of the load 82 or when the fully solidified mass 102 has only partially detached from the drum lining 46 and a remaining portion still remains solidified and attached to the drum lining 46. The partial detachment of the solidified mass 102 from the drum lining 46 is illustrated by the negative sloped dashed line at 110 in FIG. 7, followed by the dotted line 112.

Figure 9:
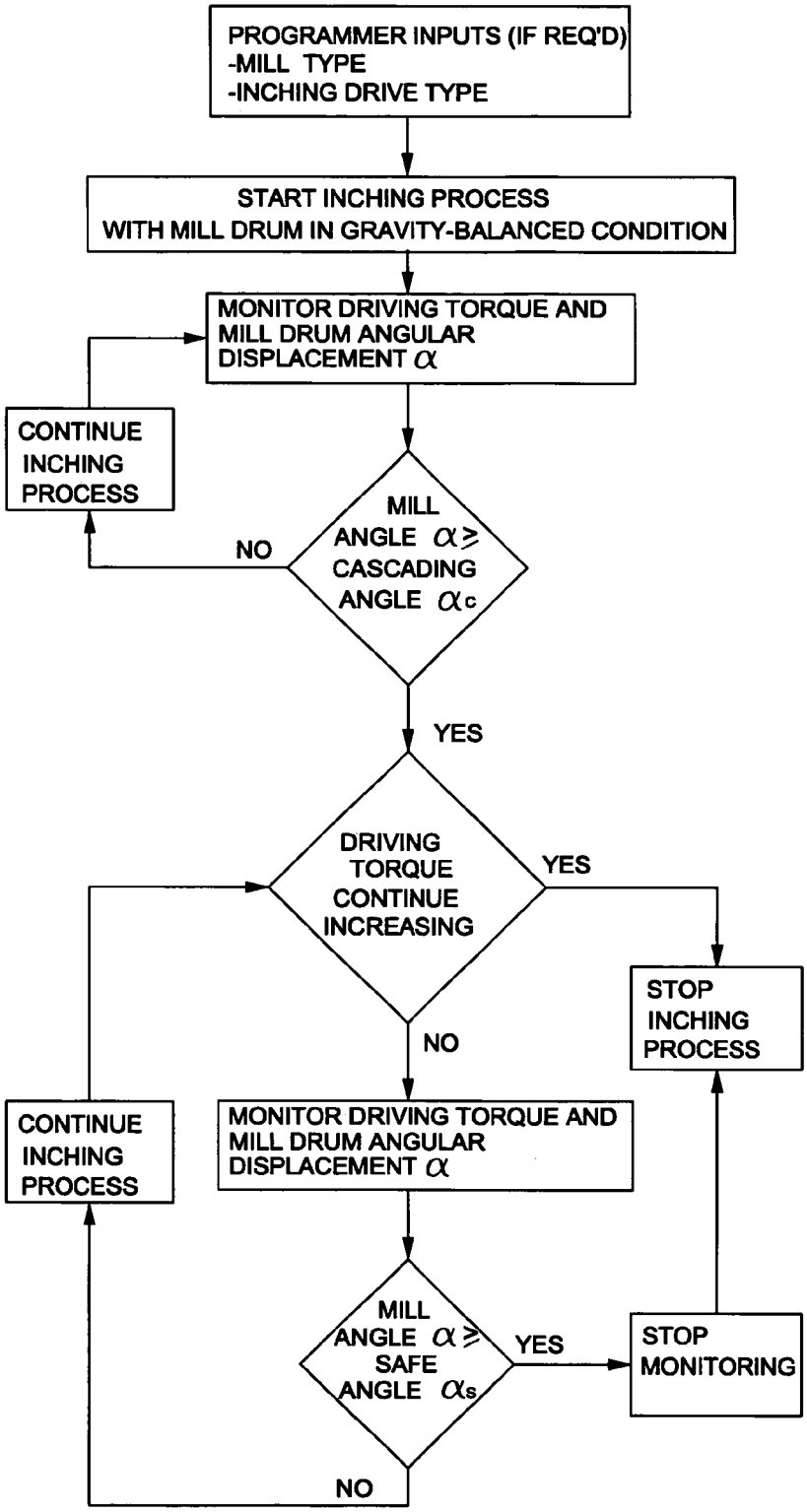
FIG. 9, in a schematic diagram, illustrates a sequence of steps part of an angle-based protection method in accordance with an embodiment of the present invention.

The proposed method and device typically makes use of the relationship between the required torque and drum rotation to assess the presence of a solidified mass 102 that may potentially damage the grinding mill 12, as schematically shown in the diagram of FIG. 9.

In situations wherein the method is used in the context of a grinding mill such as hereinabove disclosed, the proposed method includes the steps of assessing for the presence of a potentially damaging lump volume of material 102 in the mill drum 16 by evaluating if the material within the mill drum 16 is tumbling in a cascading flow upon rotation of the mill drum 16. The method further includes the step of initiating an action for stopping the rotation of the mill drum 16 upon determination that the material within the mill drum 16 is not tumbling in a cascading flow. More specifically, the step of evaluating if the material within the mill drum 16 is tumbling in a cascading flow upon rotation of the latter may include the steps of initially estimating a cascading angular displacement range 86 within which the material within the mill drum 16 is expected to separate from the inner surface 20 of the mill drum 16 and tumble in a cascading flow upon rotation of the mill drum 16 from a gravity-balanced condition. Once the cascading angular displacement range 86 has been estimated, the method includes the step of evaluating if the material within the mill drum 16 separates from the inner surface 20 of the mill drum 16 within the cascading angular displacement range 86 upon rotation of the mill drum 16 from a gravity-balanced position.

It should be understood that although the material within the drum 16 is hereinafter disclosed as potentially separating from the inner surface 20 of the mill drum 16, the description also applies to situation where the material separates from the lining 46 or any other covering material protecting the inner surface 20 of the mill drum 16.

In accordance with one aspect of the present invention, the step of evaluating if the material within the mill drum 16 separates from the inner surface 20 within the cascading angular displacement range 86 upon rotation of the mill drum 16 from the rest or gravity-balanced position includes using a torque provider (such as the primary drive motor 52 or the inching device 14) for rotating the mill drum 16 with the material contained therein. Once the mill drum 16 is rotating, the next step involves monitoring the value of the driving torque for the presence of a torque value indicating that the material has not separated from the inner surface 20 of the drum mill 16 when the mill drum 16 has rotated from the gravity-balanced position by more than the cascading angular displacement range 86. It should be understood that the spectrum of the cascading angular displacement range 86 may vary depending on the accuracy of the determination of the angle, or angular displacement from the gravity-balanced position, at which the material within the mill drum 16 separates from the inner surface 20 or the required accuracy. In the example shown throughout the figures, the cascading angular displacement range 86 is shown as being relatively narrow and identified as a single point in the graph. It should, however, be understood that the width or spectrum of the cascading angular displacement range 86, typically in the range of a few degrees or the like about a nominal cascading angle $\alpha_C$, may vary without departing from the scope of the present invention.

Preferably, the step of monitoring the value of the driving torque for the presence of a torque value indicating that the material within the mill drum 16 has not separated from the inner surface 20 of the mill drum 16 within the cascading angular displacement range 86 includes evaluating if the driving torque continues to increase when the mill drum 16 has rotated by more than the cascading angular displacement range 86 from the gravity-balanced position. Alternatively, the step of monitoring the value of the driving torque for the presence of a torque indicating that the material has not separated from the inner surface 20 within the cascading angular displacement range 86 includes evaluating if the driving torque reaches a predetermined torque threshold when the mill drum 16 has rotated by more than the cascading angular displacement range 86 from the gravity-balanced condition.

As mentioned previously, in some situations, a residual lump of material 102*a* may remain attached to the inner surface 20 despite the complementary volume of solidified material having separated from the latter. Hence, optionally, the method further includes the steps of assessing for the presence of a residual lump of material 102*a* having remained adhered to the inner surface 20 of the mill drum 16 after the latter has rotated by more than the cascading angular displacement range 86 from the gravity-balanced position despite the complementary volume of material having separated from the inner surface. The method optionally further includes the step of stopping the rotation of the mill drum 16 upon assessing the presence of a residual lump of material 102*a*.

Typically, when these optional steps are performed, the value of the driving torque is monitored for the presence of a torque value indicating the presence of the residual lump of material 102*a* when the mill drum 16 has rotated from the gravity-balanced position by more than the cascading angular displacement range 86. Typically, the driving torque is monitored until the drum 16 rotates from the gravity-balanced position by a predetermined safe angular displacement, or safe angle as, as shown in FIGS. 7 and 9. Typically, the predetermined safe angular displacement is established as being 360° or any other suitable value.

Preferably, monitoring the value of the driving torque for the presence of a torque value indicating the presence of a residual lump of material 102*a* includes evaluating if the driving torque continues to increase when the drum 16 has rotated by more than the cascading angular displacement range 86 until the drum 16 angular displacement from gravity-balanced condition reaches the predetermined safe angular displacement $\alpha_s$.

Optionally, the cascading angular displacement range 86 may be estimated by obtaining data on the value of the driving torque at various angular displacements of the drum 16 from the gravity-balanced position when the mill drum 16 is rotating and the material is tumbling in a cascading flow. In such instances, the cascading angular displacement range 86 is typically approximated to an angular displacement $\alpha$ of the mill drum 16 from gravity-balanced condition wherein the value of the driving torque is comparatively high relative to the value of the driving torque at other angular displacements of the mill drum 16.

Although the proposed method has hereinabove been disclosed in the specific context of a grinding mill wherein an evaluation of the potential risk of having solidified material 102 fall within a drum is important, the proposed method may be generalized to any suitable type of rotating component part of a machine wherein the rotating component defines a critical angular displacement value $\alpha_C$ about which an operational parameter of the machine may be used for predicting the occurrence of a potentially damaging condition for the machine. A potentially damaging condition for the machine being more susceptible to happen upon the operational parameter meeting predetermined critical parameter conditions while the rotating component reaches the critical angular displacement value $\alpha_C$. In such general terms, the method may be generalized comprising the steps of providing an evaluation of the operational parameter upon the rotating component reaching the critical angular displacement value $\alpha_C$ from gravity-balanced condition and receiving the evaluation of the operational parameter for effectuating an action in order to reduce the risks of damaging the machine upon the operational parameter meeting the predetermined critical parameter conditions.

In a sub-set of situations, the rotating component is typically a rotating drum defining a drum peripheral wall, itself defining a reference position thereof. Typically, the rotating component is coupled to a drive provider able to generate a driving torque for driving the rotating component about a component rotation axis. In such situations, the step of providing an evaluation of the operational parameter may include providing an evaluation of the angular displacement relationship between the peripheral wall reference location from the gravity-balanced position and the critical angular displacement value $\alpha_C$ and the method further includes the steps of evaluating the driving torque.

Figure 8:
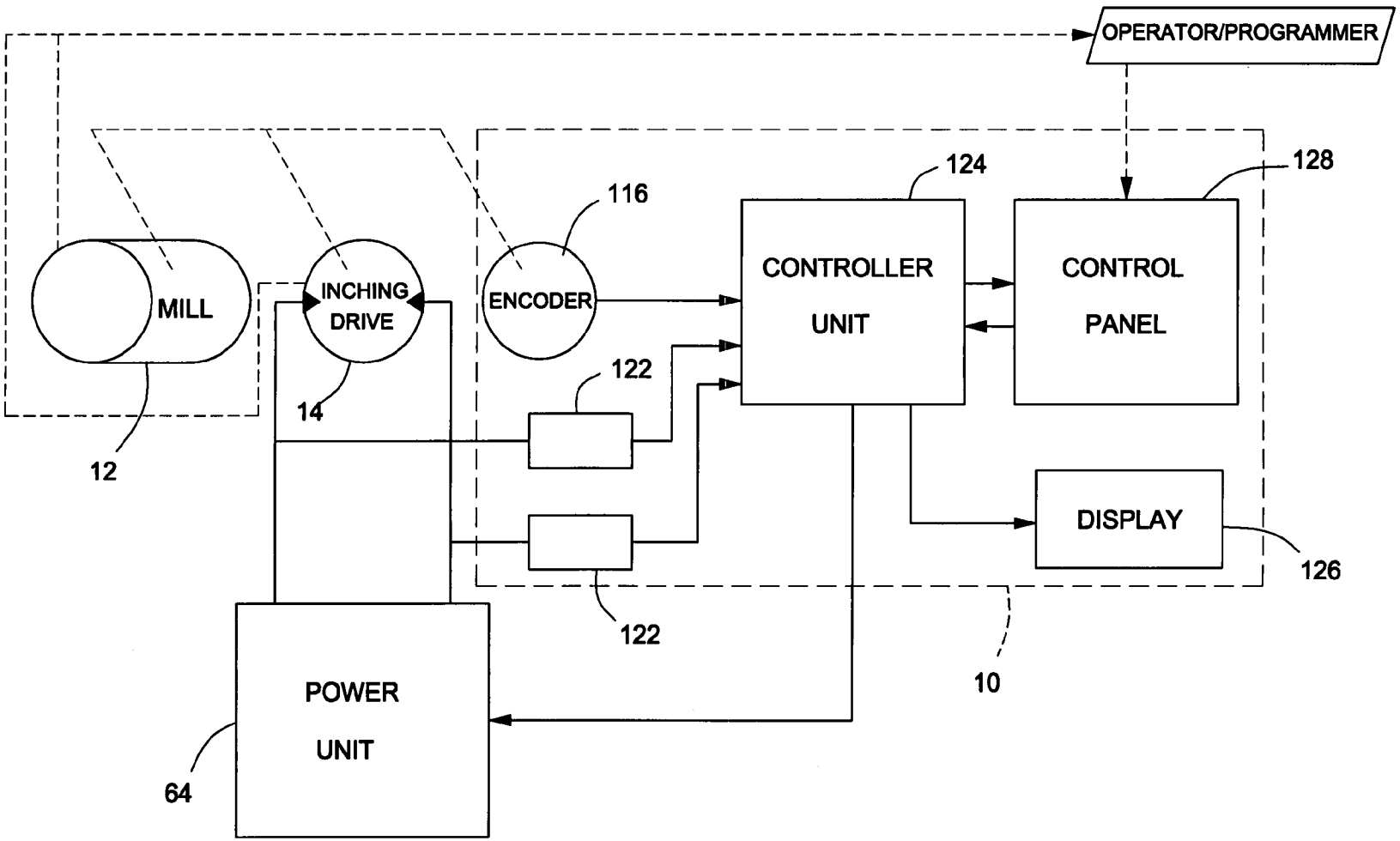
FIG. 8, in a diagram, illustrates the typical relationship between the driving torque and the rotation of the drum starting when the load is within the drum in an idle condition, the load being either normal, partially solidified or fully solidified.

Referring now more specifically to FIGS. 1 and 8, there is shown an example of a grinding mill 12 having a device 10 in accordance with an embodiment of the present invention operatively coupled thereto. The device 10 includes a parameter monitor operatively coupled to the grinding mill 12 and to the torque provider for monitoring the angular displacement of the mill drum 16 and the value of the driving torque. The device 10 also includes an evaluator operatively coupled to the parameter monitor for evaluating if the value of the torque continues to increase upon the drum 16 rotating by more than the cascading angular displacement range 86 from the gravity-balanced position. The device 10 further includes an effectuator operatively coupled to the evaluator and to the torque provider for initiating an action leading to the stopping of the rotation of the mill drum 16 if the value of the torque continues to increase upon the drum 16 rotating by more than the cascading angular displacement range 86 from the gravity-balanced condition.

Typically, the parameter monitor includes a torque monitor operatively coupled to the torque provider for monitoring the value of the driving torque so as to assess the presence of a torque value indicating that the material has not separated from the inner surface 20 of the mill drum 16 when the mill drum 16 has rotated by more than the cascading angular displacement range 86. Also, the parameter monitor typically includes an angular displacement sensor operatively coupled to the grinding mill 12 for assessing the angular displacement of the mill drum 16 from the gravity-balanced position.

In one embodiment of the invention, the angular displacement sensor includes a rotation encoder 116 operatively coupled to the grinding mill 12 for converting an operational parameter of the grinding mill 12 into an estimate of the angular displacement of the mill drum 16 from the gravity-balanced position. Typically, although by no means exclusively, the rotation encoder 116 includes a reference component 118, which could simply be the teeth of one of the gears mounted on the hydraulic motor output shaft 70 of the inching device 14, mounted on a driving shaft of the torque provider for rotating the latter. It should be understood that the torque provider could take the form of the any drive motor such as the drive motor 62 of the inching device 14 or any other suitable torque provider, as long as the angular displacement sensor is operatively coupled to the torque provider. The rotation encoder 116 further includes an inductive-type sensor 120, or an optical sensor, mounted adjacent the reference component 118 for monitoring the displacement of the reference component 118 and inferring the angular displacement of the mill drum 16 from the position of the reference component 118. Furthermore, the rotation encoder 116 could also be a conventional quadrature-type encoder, or two regular encoders with a ninety (90) degree phase shift therebetween, for determining the rotational direction of the torque provider and the mill drum without departing from the scope of the present invention.

In one embodiment of the invention, the parameter monitor includes a torque sensor operatively coupled to the torque provider for assessing the value of the driving torque. In situations wherein the torque provider is a hydraulic motor 62 part of the inching device 14, the torque sensor includes a pressure transducer 122 operatively coupled to the hydraulic circuitry 66 or hydraulic fluid lines of the hydraulic motor 62 for assessing the hydraulic pressure in the hydraulic circuitry 66 of the hydraulic motor 62. In FIGS. 1 and 8, two pressure transducers 122 are coupled to corresponding fluid lines 66 are shown since the motor 62 of the inching device 14 can be operated in either rotational direction, clockwise and counterclockwise. Optionally, both the rotation encoder 116 and the pressure transducer 122 are electrically or electronically coupled to a control unit 124 for enabling an intended user to customize the input data and its processing depending on specific operational parameters such as the type of grinding mill, the gear ratio and the like. Typically, the controller unit 124 is linked to a suitable display 126, visual or other type of display, for interfacing with the intended user.

Various actions may be taken either automatically by the controller unit 124 or through the interface 128, such as a keypad or the like, of the intended user for stopping the rotation of the mill drum 16, should the value of the torque continue to increase upon the mill drum 16 rotating by more than the cascading angular displacement range 86. For example, the controller unit 124 may send a signal to the display unit 126 to inform the intended user of the condition or may automatically send a signal to the torque provider for stopping the latter.

Alternatively, the torque sensor could be a load cell (not shown) mounted on the shaft 70 of the inching drive 14 without departing from the scope of the present invention.

Similarly, the inching drive 14 could include an electric-type motor (not shown) coupled to an amperage sensor acting as a torque sensor without departing from the scope of the present invention.

Also, the above described method for protecting the rotating drum of a grinding mill applies when the mill drum itself includes windings (not shown) so as to directly be the rotor of the driving motor. The rotor (not shown) is surrounded by the stator part of the preferably stepper-type motor so as to form a gearless type grinding mill. Accordingly, an external drum brake (not shown) is operatively coupled to the mill drum to enable stopping and holding the latter in any rotational position whenever required by the method.

Although the present angle-based method and device for protecting a rotating component have been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A device for protecting a grinding mill, at startup from a gravity-balanced condition thereof, including a rotating mill drum used for grinding material from damages caused by a potentially damaging lumped volume of said material falling from a fall position within said rotating drum and impacting an impact position within said rotating drum upon rotation thereof at startup from the gravity-balanced condition, said rotating drum being coupled to a torque provider able to generate a driving torque for rotation of said rotating drum, a presence of said potentially damaging lumped volume of said material being predictable upon an operational parameter of said grinding mill being in relation with said rotating drum meeting predetermined critical parameter conditions corresponding thereto, said device comprising:

a parameter sensor operatively coupled to said grinding mill for providing an evaluation of said operational parameter upon said rotating drum moving at startup from the gravity-balanced condition, said parameter sensor assessing the presence of said potentially damaging lumped volume of said material from the evaluation of said operational parameter meeting said predetermined critical parameter conditions;

an effectuator operatively coupled to the torque provider and to said parameter sensor for receiving an assessment of the presence of said potentially damaging lumped volume of said material thereform, said effectuator initiating an action for reducing the risks of damaging said grinding mill upon reception of the assessment of the presence of said potentially damaging lumped volume of said material.

2. A device as recited in claim 1 wherein said rotating drum has a drum peripheral wall defining a peripheral wall reference location and an inner surface thereof; and said rotating drum defines a critical angular displacement value within which said material within said rotating drum is expected to separate from said inner surface of said rotating drum and tumble in a cascading flow upon rotation of said rotating drum and about which said operational parameter of said grinding mill may be used for predicting the occurrence of a potentially damaging condition for said grinding mill in relation with said rotating drum reaching said predetermined critical parameter conditions;

said parameter sensor including an angle evaluator for providing an evaluation of an angular displacement relationship between said peripheral wall reference location and said critical angular displacement value of said rotating drum from a startup position corresponding to the gravity-balanced condition.

3. A device as recited in claim 2 wherein said parameter sensor further includes:

a torque evaluator for evaluating said driving torque relative to said angular displacement relationship during rotation of said rotating drum from said startup position.

4. A device as recited in claim 3 wherein said angle evaluator includes a rotation encoder operatively coupled to said grinding mill for converting an operational parameter of said grinding mill into an estimate of the angular displacement of said rotating drum from the startup position at said gravity-balanced condition.

5. A device as recited in claim 3 wherein said rotation encoder includes:

a reference component mounted on a driving shaft of said torque provider for rotating therewith;

an inductive-type sensor mounted adjacent said reference component for monitoring a displacement of said reference component and inferring the angular displacement of said rotating drum from the displacement of said reference component.

6. A device as recited in claim 3 wherein said torque evaluator includes a torque transducer operatively coupled to an inching device of said torque provider for assessing a torque provided by said inching device.

7. A device as recited in claim 6 wherein said inching device includes a hydraulic motor, said torque transducer is a pressure transducer operatively coupled to a hydraulic circuitry of said hydraulic motor for assessing a hydraulic pressure in the hydraulic circuitry and provide to determine the torque provided by said hydraulic motor.

8. A device as recited in claim 7 wherein said rotation encoder is mounted on said inching device.

9. A device as recited in claim 1 wherein said torque provider is an electrical driving motor coupled to said grinding mill.

10. A device as recited in claim 1 wherein said torque provider is an inching device.

11. A device as recited in claim 10 wherein said inching device includes a hydraulic driving motor.

* * * * *